US005361513A

United States Patent [19]

Woessner

[11] Patent Number: 5,361,513

[45] Date of Patent: Nov. 8, 1994

[54] METHOD AND APPARATUS FOR DRYING AND BRIQUETTING COAL

[75] Inventor: Paul W. Woessner, Evergreen, Colo.

[73] Assignee: Amax Coal Industries, Inc., Indianapolis, Ind.

[21] Appl. No.: 981,620

[22] Filed: Nov. 25, 1992

[51] Int. Cl.[5] ..... F26B 3/08; F26B 17/00

[52] U.S. Cl. ..... 34/363; 34/385; 34/578; 34/589

[58] Field of Search ..... 34/57 R, 57 A, 57 B, 34/10, 50, 30, 32, 26, 359, 360, 362, 363, 371, 385, 578, 589

[56] References Cited

U.S. PATENT DOCUMENTS

| | | | |
|---|---|---|---|
| 2,824,790 | 2/1958 | Gregory et al. | 44/19 |
| 2,860,957 | 11/1958 | Jones et al. | 44/10 |
| 2,937,080 | 5/1960 | Komarek et al. | 44/10 |
| 4,295,281 | 10/1981 | Potter | 34/10 |
| 4,304,049 | 12/1981 | Curtius | 34/10 |
| 4,354,903 | 10/1982 | Weber et al. | 201/6 |
| 4,360,487 | 11/1982 | Janusch | 264/101 |
| 4,431,485 | 2/1984 | Petrovic et al. | 202/270 |
| 4,470,878 | 9/1984 | Petrovic et al. | 201/39 |
| 4,502,227 | 3/1985 | Janusch | 34/12 |
| 4,514,912 | 5/1985 | Janusch et al. | 34/37 |
| 4,601,113 | 7/1986 | Draper et al. | 34/10 |
| 4,602,438 | 7/1986 | Draper et al. | 34/10 |
| 4,628,619 | 12/1986 | Janusch et al. | 34/180 |
| 4,725,337 | 2/1988 | Greene | 201/29 |
| 4,785,554 | 11/1988 | Herderer et al. | 34/164 |
| 5,046,265 | 9/1991 | Kalb | 34/15 |

FOREIGN PATENT DOCUMENTS

| | | | |
|---|---|---|---|
| 0273406 | 7/1988 | European Pat. Off. | F26B 3/08 |
| 292924 | 8/1991 | Germany . | |

OTHER PUBLICATIONS

G. Ellison et al; High Strength Binderless Brown Coal Briquettes, Part I. Production and Properties; *Fuel Processing Technology*, vol. 4, pp. 277–289, (1981).

G. Ellison et al; High Strength Binderless Brown Coal Briquettes, Part II. An Investigation into Bonding; *Fuel Processing Technology*, vol. 4, pp. 291–304, (1981).

Jerry R. Johanson, Ph.D. et al; Fluid Entrainment Effects in Roll Press Compaction; 20th Institute for Briquetting and Agglomeration—Proceedings, pp. 251–263 (1987).

Chemistry of Coal Utilization, Second Supplementary Vol.; Chapter 11, pp. 609–634, (1981).

Chemistry of Coal Utilization, Supplementary Vol.; Chapter 16, pp. 675–753, (1963).

M. S. Iyengar et al; Role of Hydrogen Bonds in the Briquetting of Lignite; *Journal of the Institute of Fuel*, vol. 36, pp. 76–84, (1957).

H. R. Gregory, B.Sc., B.A.; A New Process for Briquetting Coal Without a Binder; *Journal of the Institute of Fuel*, vol. 33, pp. 447–456, (1960).

*Primary Examiner*—Henry A. Bennet

*Attorney, Agent, or Firm*—Sheridan, Ross & McIntosh

[57] ABSTRACT

The subject invention is an integrated process for economically drying and briquetting coal to produce strong briquettes. The subject invention utilizes a conditioner to output dried coal having a selected moisture content and temperature and mean particle size and size distribution for briquetting. The conditioner reduces the moisture content of coal particles by contacting them with steam. The preferred conditioner fluidizes a bed of coal particles with steam generated during the coal drying process. The moisture content of the dried coal is in the form of steam which fills the pores and inter-particle void spaces of the coal particles. The moisture content of the dried coal is controlled by supplying heat to heat exchange tubes in the coal bed in response to coal bed temperature. The bed temperature is related to the moisture content of the dried coal. The dried coal is sealed from the atmosphere and conveyed at isothermal conditions to the briquetter to maintain the coal temperature and moisture content constant. During briquetting, the steam in the particles' pores and inter-particle void spaces is condensed into water, collapsing the pore structures and filling the pores and inter-particle void spaces in the coal particles with water. This action produces a high density briquette which is resistant to moisture reabsorption and spontaneous combustion.

41 Claims, 5 Drawing Sheets

METHOD AND APPARATUS FOR DRYING AND BRIQUETTING COAL

FIELD OF THE INVENTION

This invention relates generally to conditioning coal to reduce moisture content and briquetting the coal into desired shapes and specifically to the conditioning and briquetting of sub-bituminous coals.

BACKGROUND OF THE INVENTION

The coal industry reduces the moisture content of coal prior to shipping the coal to utilities and industrial coal burning customers to increase the heating value of the coal by reducing the coal's weight per unit of energy. The price of coal sold to utilities depends upon the heating value of the coal at the mine. In addition to bringing a higher unit price for coal, reducing the moisture content of coal increases the efficiency of the power plant, decreases transportation costs, decreases ash disposal requirements, and decreases power plant emissions.

An important consideration in reducing the moisture content of coal is the manner in which moisture is contained in coal particles. Coal particles typically have both a surface and an inherent moisture content. The inherent moisture content represents water retained in the cells and capillaries distributed .throughout the coal particle matrix. As used herein, "cells" refers to discrete void spaces in the coal particle matrix and "capillaries" refers to vein-like fissures connecting the cells.

The surface and inherent moisture contents of coal may be reduced in a variety of apparatuses including travelling bed driers, autoclaves, cascading bed driers, and fluidized bed driers. As used herein, "fluidized bed drier" refers to an apparatus which reduces the moisture content of a particle by passing a gas, including hot products of combustion and steam, through a bed of particles. The bed of particles in the fluidized bed drier is known as a fluidized bed and the gas passing through the fluidized bed is known as the fluidizing gas. The primary objectives of conventional coal drying operations are to obtain the lowest possible moisture content in the coal particles for a variety of end uses such as combustion, coking, and gasification, and/or obtain a high density and to cause a reduced likelihood for spontaneous combustion of the coal particles by collapsing as many cells and capillaries as possible. Cells and capillaries are believed to collapse as water contained in the cells and capillaries is removed.

Conventional coal drying operations have a number of problems. First, the drying operations tend to be quite complex which translates into high capital and operating costs. For example, many operations employ multiple heat exchangers, condensers, cyclones, and so forth in addition to complex and expensive fire prevention equipment. Second, many operations operate at superatmospheric pressure to collapse cells and capillaries which requires more expensive equipment to resist the increased operating pressures. Third, many operations require excessive amounts of heat to dry the coal. The high amounts of heat result both from the need to heat the system to high drying temperatures and the inefficiencies caused by high heat losses and poor heat exchange rates. Finally, conventional coal drying processes generate excessive amounts of coal fines. Coal fines are created during the drying of the coal as water is removed. The removal of water from the coal weakens the coal structure causing attrition in particle size.

The suppression of the coal fines generated during the drying of coal is a major problem in the coal and utility industries. Releases of coal fines during transportation, processing, and handling of coal cause health and safety problems and pollution. Such releases also increase operating costs for the coal and utility companies through unrecoverable coal losses and complications in coal handling and storage.

Coal fines may be compressed into agglomerates, such as briquettes. As used herein, "agglomerate" refers to any consolidation of particles to form a consolidated mass and "briquette," as used herein, refers to an agglomerate produced by compressing particles under externally applied pressure. There are numerous methods to compress coal particles into briquettes, including but not limited to extruding, ringrolling, roll pressing, and die pressing.

Coal may be compressed into briquettes with or without a binder. As used herein, "binder" refers to an additive to produce or promote cohesion in loosely assembled substances. Binders are more expensive than the coal itself and substantially increase costs associated with briquetting.

Binderless briquetting may be done by two methods. First, a fraction of the coal particles may be heated to their softening point and then compressed to bind the coal particles with naturally occurring tar pitch. This approach is extremely expensive as it requires the coal to be heated to temperatures in excess of 300° C. Second, briquetting may combine the adhesive effects of high compaction pressures and coal moisture to cause particle consolidation. This type of binderless briquetting demands careful preparation of the coal particles to produce strong briquettes, thereby substantially increasing coal costs. The preparation includes crushing the coal particles to a fine size, conditioning the coal particles for briquetting and compressing the coal particles under extreme pressure. Coal particle conditioning is a significant problem in conventional briquetting operations as coal particles dried in conventional drying operations do not make strong briquettes without the addition of substantial amounts of binder. In both binder and binderless briquetting there is the additional problem that coal briquettes often swell and crack during cooling.

SUMMARY OF THE INVENTION

The subject invention overcomes the numerous problems of conventional coal conditioning and briquetting processes based in part upon the recognition that the briquetting of coal, particularly sub-bituminous coal, produces stronger briquettes if substantially all of the particles to be briquetted have a certain moisture content, temperature, mean particle size and size distribution and are maintained in a steam environment until briquetting occurs. As used herein, "coal" refers to lignite, sub-bituminous, and bituminous coals, peat, and wood. As will be understood by those skilled in the art, "coal" has a different definition in common industry usage. It has been determined that less compaction pressure is required to produce strong briquettes if the moisture content of the coal particles is in the form of steam filling substantially all of the pores of the particles to be briquetted. As used herein, "pore" refers to the capillaries, cells, and other void spaces in the structure of a coal particle. Important aspects of the invention are the recognition that a steam environment surrounding the coal particles before briquetting maintains steam in both the coal particles' pores and the void spaces between coal parties (or inter-particle void spaces) and that the temperature of the steam surrounding the coal particle before briquetting determines the coal particle temperature and therefore the amount of moisture in the pores. Upon compression the steam in substantially all of the pores and inter-particle void spaces condenses into water which fills the pores and spaces. While not wishing to be bound by any theory, it is believed that the moisture content upon compression creates higher particle bonding energies by means of hydrogen bridging and van der Waals forces and therefore denser and stronger briquettes. To produce dried coal particles having a consistent and specific moisture content, temperature, mean particle size and size distribution, the subject invention preferably includes a conditioner. As used herein, "conditioner" refers to any device that contacts particles with steam to reduce the moisture content of the particles to a desired level. Preferably, the conditioner maintains the particles in a steam environment to maintain the particle moisture content at the desired level. A preferred conditioner is a fluidized bed conditioner because of its relatively low capital and operating costs. As used herein, "fluidized bed conditioner" refers to a fluidized bed drier that uses steam as the fluidizing gas to reduce the moisture content of the particles in the fluidized bed. By fluidizing and heating the bed with steam to reduce the moisture content of coal particles, the fluidized bed conditioner outputs coal particles having steam in substantially all of the pores and inter-particle void spaces.

The conditioner outputs coal particles having selected moisture contents and temperatures by controlling the steam temperature in the conditioner. Since the steam temperature is a function of the amount of heat inputted to the conditioner, the moisture content may be controlled by adjusting the conditioner heat input. It was determined that the particle moisture content could be controlled in this manner by allowing the coal particles to establish thermal equilibrium with the steam contacting the particle before being outputted from the conditioner. At thermal equilibrium, the entire particle will have substantially the same temperature as the steam surrounding the particle. Since the particle temperature is related to the moisture content for the particle, a selected particle moisture content may be achieved by obtaining a given particle temperature. At the preferred particle temperatures, the water in the particle pores (e.g., particle inherent moisture content) is converted into steam having a density correlating to the selected moisture content. To maintain the temperature and moisture content of the outputted particles substantially constant, the particles outputted by the conditioner may be transported to the briquetter in a sealed environment.

In one aspect of the invention, the conditioner is a fluidized bed conditioner and the moisture content of the coal particles outputted by the fluidized bed conditioner is a function of the temperature of the fluidized bed. The uniformity of temperature in particles outputted by the fluidized bed conditioner is a result of substantially all of the particles in the lower area of the bed having the same temperature. The isothermal condition in the lower bed area is a result of substantially all of the particles in the lower bed area attaining equilibrium with the steam fluidizing the bed before being outputted.

In a preferred embodiment, a fluidized bed conditioner may include a first inlet and first outlet for coal particles, a bed of coal particles located between the first inlet and first outlet, a fluidizing distributor to fluidize the bed of coal particles with steam to convert moisture in the particles' pores into steam, and a heater operatively connected to heat exchange tubes in the bed to supply heat to the steam to maintain a selected temperature for the bed. The selected temperature of the bed depends upon the desired moisture content for coal particles to be outputted by the fluidized bed conditioner. The dried coal particles possessing steam in substantially all of their pores may be transported to a briquetter in a steam environment sealed from the atmosphere to maintain the outputted particles' temperature and moisture content substantially constant. The steam in the sealed environment may be steam from the fluidized bed conditioner. The steam in the fluidized bed conditioner may be generated by evaporating water from the coal particles. Preferably, the sealed environment is substantially free of compressible gases. As used herein, "compressible gases" refers to any gas that behaves as an ideal gas at the temperatures and pressures in the briquetter. An "ideal gas" is any gas that follows Boyle's law, which states that at a constant temperature, the volume occupied by a fixed quantity of gas is inversely proportional to the applied pressure. Liquids have a constant volume and therefore do not obey Boyle's law. Examples of compressible gases include without limitation carbon dioxide, carbon monoxide, oxygen, and nitrogen.

In operation, the subject invention includes the following steps: (i) identifying a desired moisture content of the coal particles to be outputted by the conditioner with the moisture content being dependent upon the composition and structure of the coal particles inputted to the conditioner; (ii) selecting a coal particle temperature based on the moisture content of the coal particles to be outputted by the conditioner; (iii) inputting coal particles to be dried into the conditioner; (iv) supplying heat in the form of steam by contacting the steam with the coal particles; (v) maintaining the coal particle temperature at about the selected temperature by controlling the steam temperature; (vi) outputting the dried coal particles from the conditioner; (vii) conveying the outputted coal particles having steam in substantially all of their pores and inter-particle void spaces to a briquetter; and (viii) compressing the outputted particles having steam in their pores into briquettes. During briquetting, the steam condenses in the pores and inter-particle void spaces to reduce briquetting pressure within the particles and thereby aid in the compaction of the coal. In the preferred embodiment, the coal particles are retained in the conditioner for a predetermined time sufficient for the coal particles to be outputted to achieve thermal equilibrium corresponding to the moisture content identified in step (i). The predetermined time is a function of the inputted particles' chemical composition and structure and mean particle size and size distribution.

In a further embodiment of the present invention, sub-bituminous coal particles having a moisture content of about 20 to about 32% water are inputted into a fluidized bed conditioner. In this embodiment, the fluidized bed conditioner utilizes a heat exchange rate for the heat exchange tubes ranging from about 40 to about 55

Btu/hr/sqft/°F. The thermal medium flowing through the heat exchange tubes has a temperature ranging from about 50° to about 150° F. above the bed temperature. The desired moisture content of the coal particles outputted by the fluidized bed conditioner ranges from about 5 to about 10 percent water by weight. The selected temperature for the fluidized bed ranges from about 215° to about 260° F. depending on barometric pressure and elevation (which control the boiling point of the water in the coal particle pores). The fluidized bed temperature has a degree of superheat ranging from about 10° to about 60° F.

The subject invention overcomes the problems experienced in conventional coal drying and/or briquetting operations. First, the present invention overcomes the need to add binder during briquetting by designing a fluidized bed conditioner that outputs coal particles substantially all of which have moisture contents, temperatures, and a mean particle size and size distribution that substantially optimizes briquetting. The presence of steam in the pores of the coal particles and inter-particle void spaces makes it possible to economically produce a high strength briquette without the use of a binder. In contrast, conventional coal drying processes do not recognize the need to attain such coal characteristics prior to briquetting. Rather, conventional coal drying processes typically focus on decreasing the moisture content of the coal as much as possible.

Second, the present invention further recognizes that conventional briquetting operations produce low quality briquettes partly because the briquetted coal particles have an uneven distribution of inherent moisture. The present invention overcomes the inability of conventional coal drying processes to produce coal particles having a substantially uniform moisture content throughout the particle by permitting the coal particles to establish thermal equilibrium before being outputted by the drier. The present invention recognizes that conventional coal drying processes produce dried coal particles having an unevenly distributed inherent moisture content (e.g., having more moisture in the particle center than near the particle surface) as a result of (i) the collapse of outer coal particle pores during heating, (ii) the high drying temperatures employed, and (iii) the processes' variance of particle residence time in the drier to obtain desired particle moisture contents. Concerning the collapse of the outer pores, a particle's surface moisture content is removed first as a coal particle is heated. Heat then conducts into the coal particle evaporating inherent moisture from the outer pores. It is believed that the pores decrease in size in direct relation to the amount of pore water removed. The shrinkage of the outer pores as water is removed makes it difficult to remove water from the inner pores. This problem is substantially magnified at temperatures above 500° F. as little, if any, moisture remains in the outer pores at such temperatures. In the present invention, however, a portion of water from coal particle pores is expelled and the remainder is converted into steam. At equilibrium, substantially all of the particles' pores contain steam. To achieve this result, the present invention uses drying temperatures lower than 500° F. The present invention's ability to retain coal particles for a sufficient period of time to attain thermal equilibrium with the steam surrounding the particle in the conditioner lets the conditioner control particle moisture content by varying the coal particle temperature alone and not the residence time.

Third, the subject invention produces briquettes that have a reduced probability of swelling and cracking during cooling based on the recognition that such swelling and cracking is typically due to the effects of air entrainment in the pores and the lack of pore equilibrium in the coal particles to be briquetted (both thermal equilibrium and equilibrium in the particle pore moisture content). The present invention fills the pores and inter-particle void spaces with steam that is substantially free of compressible gases. During briquetting the condensation of the steam in the pores and inter-particle void spaces avoids the entrainment of gases in the pores. Typically, conventional fluidized bed driers using combustion gases to fluidize a bed of coal particles create steam in only about 66% by volume of the void fraction of the particles, as opposed to at least 75% by volume of the particle void fraction for the present invention.

Fourth, the conditioner of the subject invention has reduced capital and operating costs over conventional processes by employing steam formed by the evaporation of water from coal particles to reduce the moisture content of the particles. For example, the use of steam generated by the evaporation of coal moisture eliminates the need for a boiler to produce steam to fluidize the particles.

Fifth, the subject invention is less complex and more efficient than conventional processes. The use of steam generated in the coal bed and heat exchangers in the coal bed to heat the steam not only provides high heat transfer rates but also decreases the equipment required for the process.

Sixth, the substantial absence of oxygen in the conditioner and atmosphere surrounding the coal particles during transportation to the briquetter substantially decreases the probability that the coal particles will combust due to the high temperatures present in the system. This decreased probability of combustion in turn reduces the need for expensive fire prevention and control apparatuses.

Seventh, the absence of compressible gases in the particles pores and inter-particle void spaces to be briquetted enables good briquettes to be produced at a relatively higher output than conventional processes with little swelling or cracking of the briquettes. Compressible gases in the pores create an increased resistive pressure to the pressure exerted by the briquetter, which translates into a lower output of briquettes.

Finally, the briquettes of the present invention have a significantly increased heating value over coal particles dried by conventional methods. For example, some coal particles dried by the present invention start with a heating value of about 6,000 Btu/lb and convert the coal particles into briquettes having a heating value of at least 11,000 to about 12,000 Btu/lb. Compared to the conventional operations, the increased heating value further increases power plant efficiency and decreases transportation costs, ash disposal problems, and power plant emissions.

DETAILED DESCRIPTION

Figure 1:
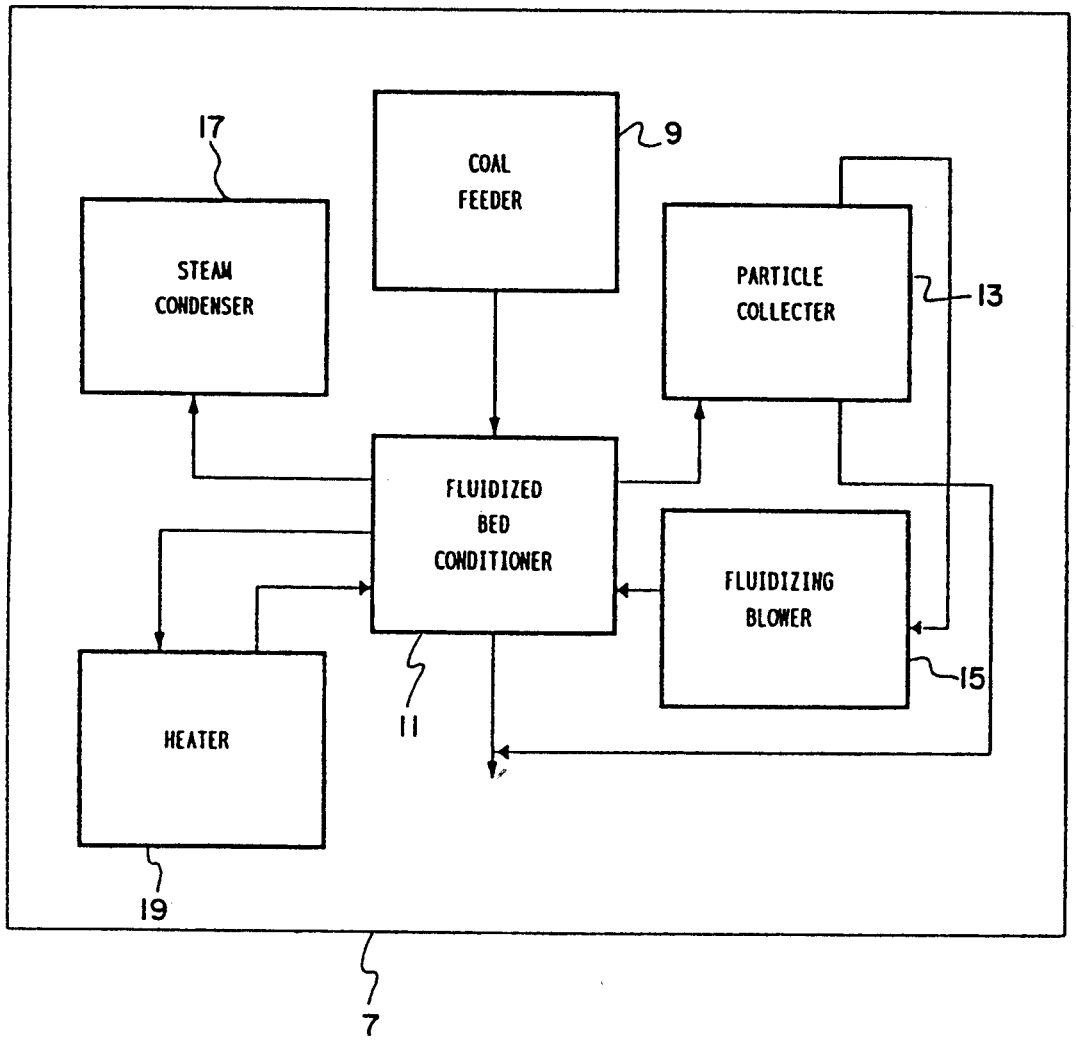
FIG. 1 is a flow schematic of an embodiment of the subject invention showing the interaction of the various process components in the fluidized bed conditioner assembly.

The present invention is generally applicable to coal and specifically applicable to bituminous, sub-bituminous, and lignite coals. In the preferred embodiment, the present invention is applicable to sub-bituminous coals.

Prior to briquetting, the present invention removes the moisture from the pores of coal particles through the use of a conditioner. The design of the conditioner recognizes that (i) the density and strength of briquettes are substantially influenced by the magnitude and uniformity of the moisture content and temperature and the mean particle size and size distribution of the particles to be briquetted, and (ii) a preferred condition for briquetting exists when substantially all of the pores in the particles to be briquetted and inter-particle void spaces are filled with steam having a moisture content substantially equivalent to the desired particle moisture content for briquetting. Preferably, at least 75%, more preferably at least 80%, and most preferably at least 98% by volume of the void fraction of the particles contains steam.

Concerning the importance of the magnitude and uniformity of the moisture content to briquetting, the preferred moisture content of coal particles for briquetting is a function of particle composition and structure. The composition and structure of sub-bituminous, bituminous, and lignite coals will generally vary by coal bed seam and location in the seam. It is important that the moisture content of the particle to be briquetted is substantially uniformly distributed throughout the particle. This is accomplished in the present invention by filling the pores and inter-particle void spaces with steam. The preferred moisture content of the steam in the pores and inter-particle void spaces is that amount which when condensed during briquetting will produce an amount of water sufficient to fill the pores and inter-particle void spaces in the briquette. During briquetting, the pores and inter-particle void spaces reduce in size. While not wishing to be bound by any theory, it is believed that the collapsing of a steam bubble during condensation assists in collapsing the pores and inter-particle void spaces by reducing internal particle pressure, thereby increasing the density of the briquette.

It is important that the moisture content of the steam when condensed not produce more water than is needed to fill the pores and inter-particle void spaces. If too much water is produced upon condensing the steam, the briquettes will shrink and crack as they are cooled. If too little water is produced upon condensing the steam, the briquettes will swell and lose strength as they are cooled. As noted above, it is believed that the presence of water and steam in the pores and inter-particle void spaces increases the particle-to-particle bonding energy in the briquette created by van der Waals forces and hydrogen bridging. This increased bonding energy and decreased void fraction increases the density and strength of the briquette. Increasing the density of the briquette reduces the tendency for oxidation by reducing internal briquette void space and surface area, increases structural strength, and reduces degradation of the briquette.

Concerning the importance of the magnitude and uniformity of particle temperature to briquetting, the preferred temperature of a particle for briquetting is a function of the desired briquette density, properties of the feed coal, and the moisture content of the particles to be briquetted. If there are variations in particle temperature in the particles to be briquetted, the particles will have not only different moisture contents but also different bonding strengths. Variations in the physical properties of the coal particles will affect the spontaneous combustion and moisture absorption properties of the briquette.

Concerning the importance of the mean particle size and size distribution to briquetting, the packing fraction in the final briquette is directly related to the density and strength of the briquette. Higher packing fractions produce higher briquette densities. To obtain a high packing fraction, it is important to maintain an essentially straight line size distribution as described on a Rosin Ramlers plot of particle size as a function of cumulative sample weight.

The subject invention employs a conditioner that outputs particles having a substantially uniform selected moisture content and temperature and a selected mean particle size and size distribution. The moisture content of the outputted particles may be controlled by controlling the heat supplied to the conditioner by the steam. In one aspect of the present invention, the steam is heated in a fluidized bed conditioner by a thermal medium conveyed through heat exchange tubes which contact the steam.

The preferred conditioner is a fluidized bed conditioner. For a fluidized bed conditioner, the moisture content of the outputted particles is a function of the temperature of the coal bed. The amount of heat to be supplied for a selected particle moisture content is therefore determined based upon the bed temperature. The heat is supplied to the bed by heating the steam fluidizing the bed.

The particles outputted by the conditioner are preferably sealed from the atmosphere during transportation to the briquetter. Preferably, the atmosphere during transportation of the particles to the briquetter is substantially composed of steam from the conditioner. The use of a sealed environment during transportation to the briquetter not only reduces the likelihood of combustion of the outputted coal particles but also substantially maintains the moisture content and temperature of the outputted coal particles constant.

Preferably, the atmosphere in the conditioner and sealed environment during transportation to the briquetter includes less than about 25% by volume of compressible gases and at least 75% by volume steam. The atmosphere may include condensible gases other then steam which, like steam, will condense under the particle temperatures and pressures experienced during briquetting. Although some of the gases produce a liquid that will adversely impact briquette quality, some produce liquids that improve briquette properties. For example, alcohols may be mixed with coal particles inputted into the conditioner. The alcohol will be converted into a gas under the conditions of temperature and pressure in the conditioner. During briquetting, the alcohol vapor condenses into liquid alcohol which, like the water from the condensed steam, enters the pores in the coal particles and inter-particle void spaces. The alcohol increases the bonding forces in the briquette and therefore the briquette density and strength. After briquetting, the alcohol evaporates from the briquette when the briquette is exposed to the ambient atmosphere. The alcohol may be condensed and recycled into the conditioner.

Figure 2:
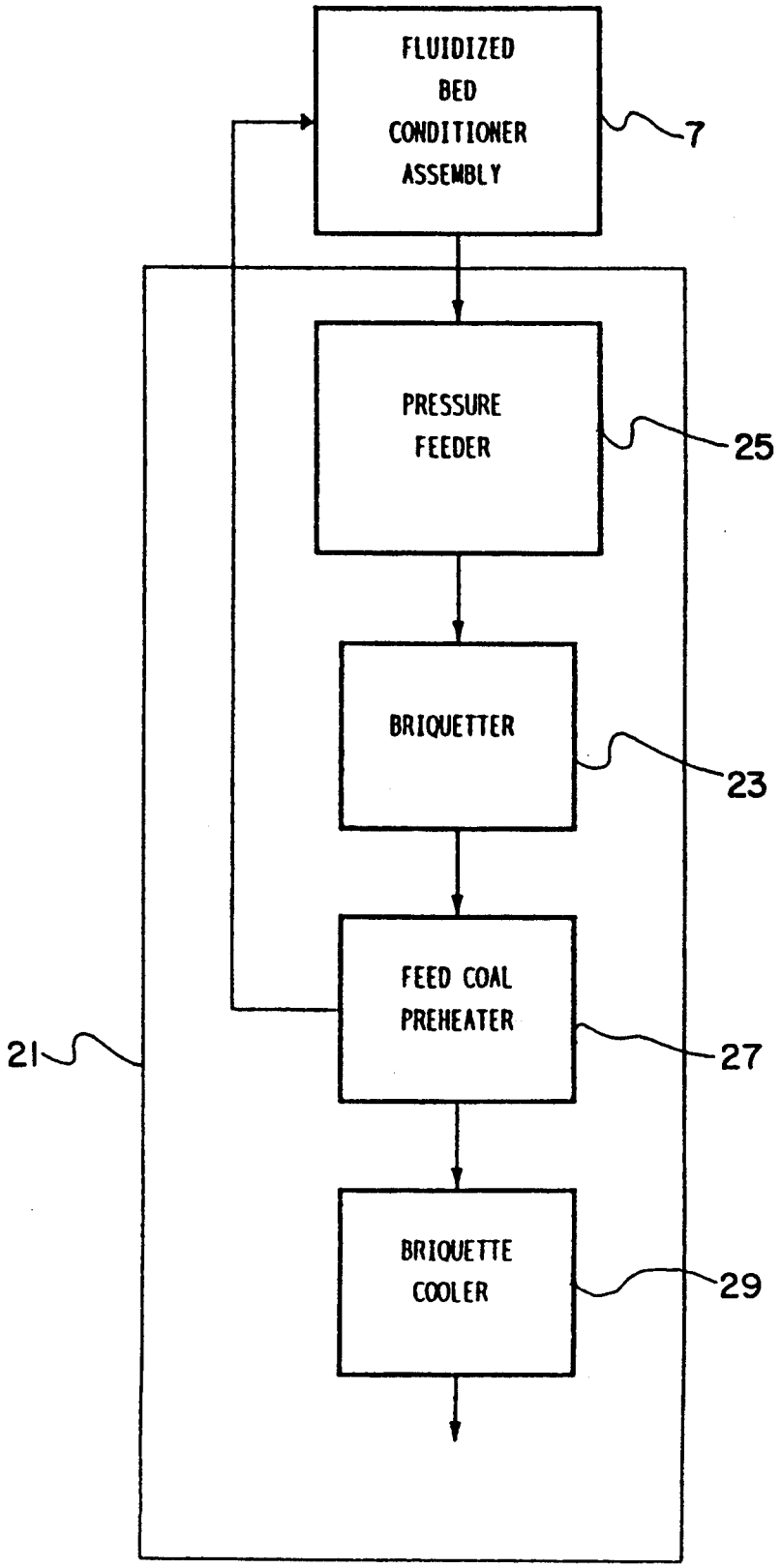
FIG. 2 is a flow schematic of an embodiment of the subject invention showing the interaction of process components in the fluidized bed conditioner and briquetting assemblies.

One embodiment of the present invention is illustrated in FIGS. 1 and 2. Referring to FIG. 1, a fluidized bed conditioner assembly 7 includes a coal feeder 9, a fluidized bed conditioner 11, a particle collector 13, a fluidizing blower 15, a steam condenser 17, and a heater 19. Referring to FIG. 2, a briquetting assembly 21 includes a briquetter 23, a pressure feeder 25, a feed coal preheater 27, and a briquette cooler 29.

Figure 3:
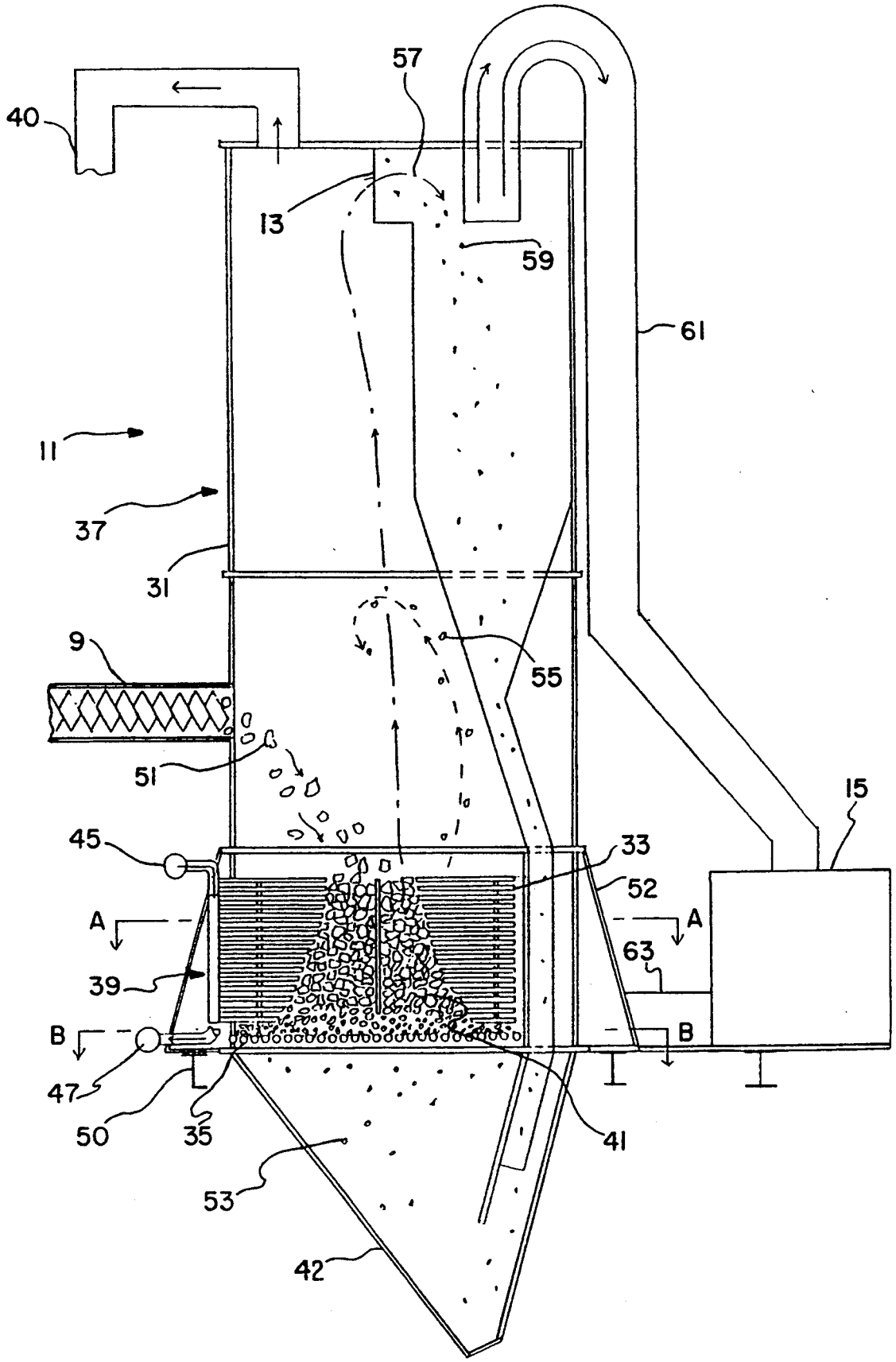
FIG. 3 is a cross-section of an embodiment of the fluidized bed conditioner showing the disengagement and fluidized bed zones of the fluidized bed conditioner, the heat exchange tubes, and the fluidizing distributor.

Before discussing the operation of the fluidized bed conditioner and briquetting assemblies 7, 21, it is important to understand the structure and operation of the fluidized bed conditioner 11. Referring to FIG. 3, in one embodiment of the present invention the fluidized bed conditioner includes a conditioner housing 31, heat exchange tubes 33, and fluidizing distributor 35. The conditioner housing 31 is divided into three parts, a disengagement zone 37, a coal bed 39, and an output hopper 42.

Figure 4:
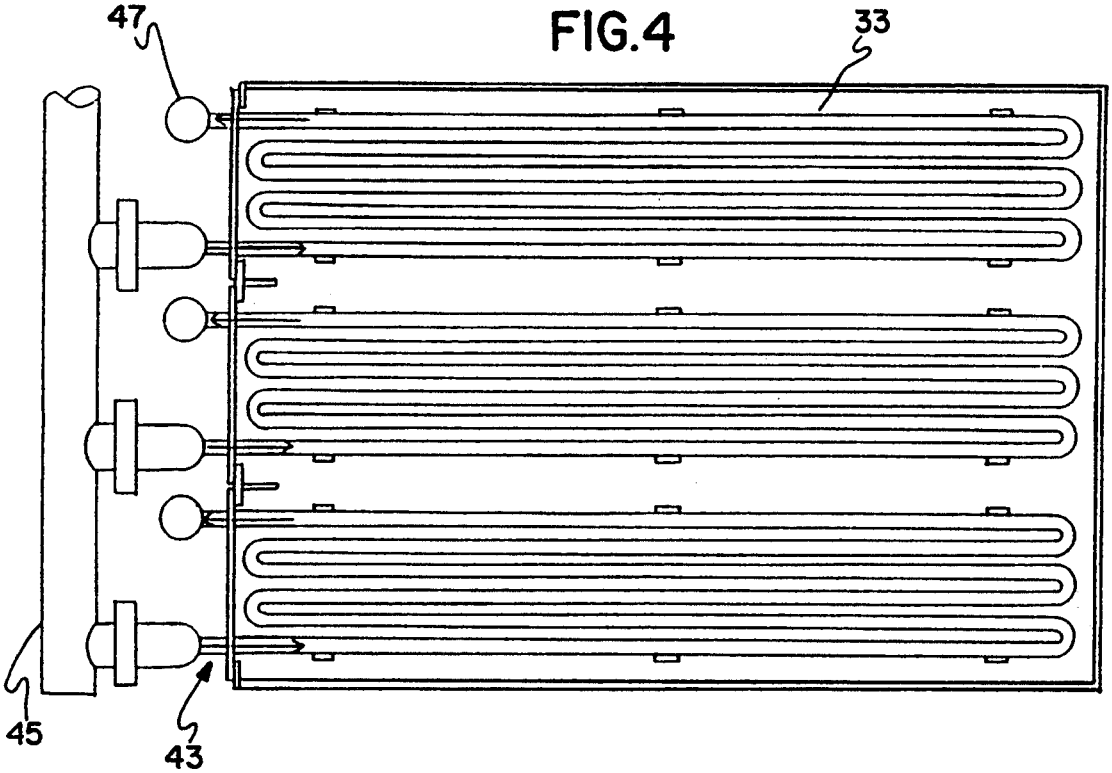
FIG. 4 is a cross-sectional view along line A—A of FIG. 3 with the coal particles removed to more clearly show an embodiment of the heat exchange tubes.
Figure 5:
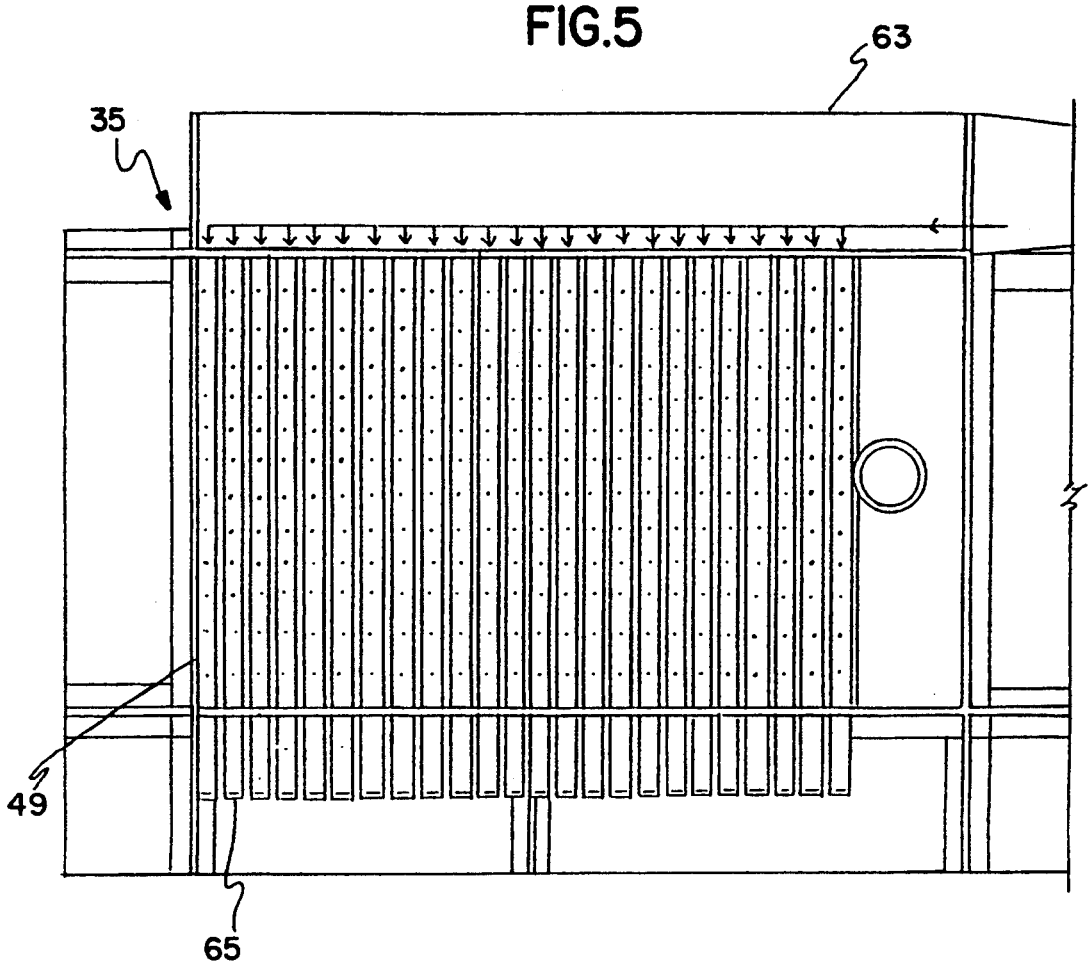
FIG. 5 is a cross-sectional view along line B—B of FIG. 3 with the coal particles removed to more clearly show an embodiment of the fluidizing distributor.
Figure 6:
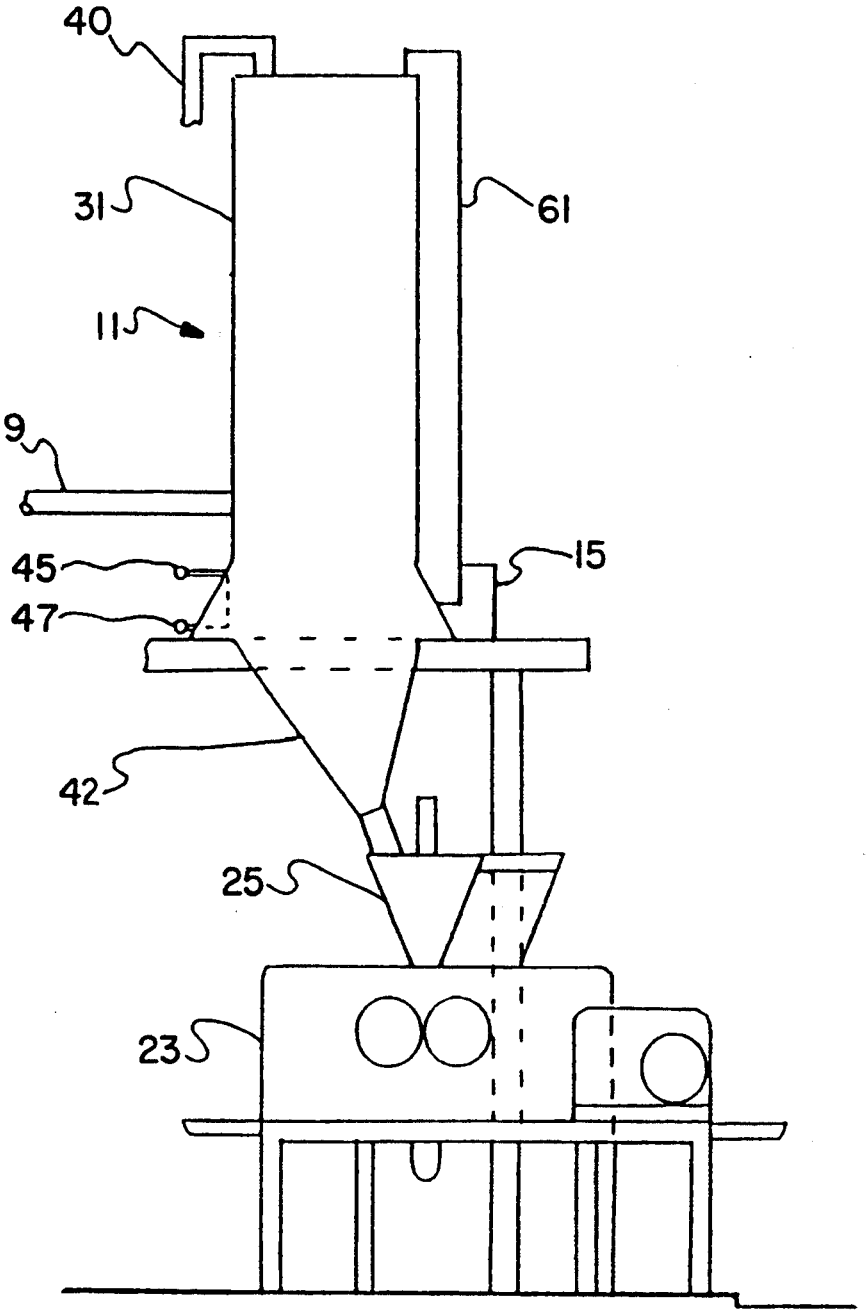
FIG. 6 is a view of the preferred embodiment of the present invention.

As shown in FIGS. 3, 4 and 6, the heat exchange tubes 33 located in the coal bed 39 are used to supply heat to the coal bed 39. As will be known and understood by those skilled in the art, heat exchange tubes 33 may include a number of heat exchange tube configurations other than that shown in FIG. 4 so long as the heat exchange tubes 33 supply heat substantially uniformly across a cross section of the coal bed 39. The area of the heat exchange tubes 33 contacting the coal bed 39 is a function of the volume of the coal particles inputted into the coal bed 39, the heat transfer rate between the heat exchange tubes 33 and coal particles 41 in the coal bed 39, the coal bed temperature, and the thermal conductivity of the coal particles 41. The number of heat exchange tube sets 43 is a function of the amount of heat transferred across the length of each heat exchange tube set 43 during normal operation. If too few heat exchange tube sets 43 are employed, the coal particles in the downstream sections of each heat exchange tube set 43 may receive insufficient heat to evaporate the inherent moisture of the coal particles 41. The distance between each heat exchange tube 33 should be sufficient to permit the passage of coal particles 41 between the heat exchange tubes 33.

A thermal medium passes first through the header 45, second through each heat exchange tube set 43, and finally through each of the outlet header tubes 47 which return the thermal medium to the heater 19 for reheating. As used herein, "thermal medium" refers to any gas or liquid capable of transferring heat from the heater 19 to the walls of the heat exchange tubes 33 to the coal particles 41. In one embodiment, steam is employed as the thermal medium. The steam may be from a fired boiler. The temperature of the coal bed 39 is controlled by controlling the amount of heat transferred through the walls of the heat exchange tubes 33 to the coal particles 41 and steam contacting the heat exchange tubes 33. The amount of heat transferred through the walls of the heat exchange tubes 33 is a function of the rate of heat transfer from the thermal medium to the coal particles 41, temperature of the thermal medium, and steam contacting the heat exchange tube 33. The rate of heat transfer (or heat transfer rate) is a function of the velocity of the steam through the coal bed 39 (or fluidizing velocity). The amount of heat transferred through the walls of the heat exchange tubes 33 is controlled by means of the heater 19 which supplies heat to the thermal medium in direct response to bed temperature. The bed temperature may be determined by any means known in the art, including a thermocouple. In this manner, the coal bed 39 is maintained at a selected temperature during operation.

The fluidizing distributor 35 may be any device that distributes steam substantially uniformly across the cross section of the coal bed 39. The fluidizing distributor 35 assures a substantially uniform distribution of the steam by utilizing a predetermined pressure drop as the steam leaves the fluidizing distributor 35. As shown in FIG. 3, the fluidizing distributor 35 and fluidizing gas together support the coal bed 39.

In one embodiment, the fluidizing distributor 35 comprises a number of tubes 49. As will be known and understood by those skilled in the art, other configurations of tubes may be employed so long as the configuration distributes steam substantially uniformly across the cross section of the coal bed 39. The space between the tubes 49 is a function of the desired mean particle size and size distribution of the dried coal particles, which pass between the tubes 49 before entering the output hopper 42.

The fluidizing velocity of the steam through the coal bed 39 is a function of the mean particle size and size distribution of the coal particles 51 inputted into the fluidized bed conditioner 11. A small mean particle size and narrow size range is desired for even fluidization of the bed by the steam.

The selected fluidizing velocity will be a balance between achieving high heat transfer rates, which is determined by the fluidizing velocity, and feed coal mean particle size and size distribution. The mean particle size is a function of the properties of the feed coal particles. Higher velocities of the steam through the coal bed 39 produce higher heat transfer rates. However, higher velocities of the steam through the coal bed 39 entrain greater amounts of coal particles and carry them out of the coal bed 39 adversely affecting conditioner performance.

The steam is heated primarily by the heat exchange tubes 33 and the coal particles 41 surrounding the heat exchange tubes 33. Accordingly, the temperature of the steam is a function of the temperature of the thermal medium in the heat exchange tubes 33. The temperature of the coal bed 39 is in turn related to the temperature of the steam. The temperature of the coal bed 39 is selected based on a selected temperature and moisture content of coal particles to be outputted by the fluidized bed conditioner 11. The temperature of the coal bed 39 is substantially uniform in the lower region of the coal bed 39. In the upper region of the coal bed 39, there will be temperature variations as a result of the need to heat raw feed coal 51 inputted into the fluidized bed conditioner 11. Consequently, the steam may be either saturated or superheated, depending upon the localized temperature of the coal particle and its location in the fluidized bed conditioner 11.

As used herein, "superheated steam" refers to steam having a temperature greater than the boiling point of water at a specified pressure in the conditioner. The difference between the steam temperature and the boiling point of water is called the degree of superheat. Higher degrees of superheat translate into a lower moisture content of coal particles to be outputted by the fluidized bed conditioner 11. Lower degrees of superheat and therefore higher steam densities translate into a higher moisture content of coal particles to be outputted by the fluidized bed conditioner 11. This relationship between the degree of superheat and the moisture content of the coal particles is true at elevations both above and below sea level, even though the boiling point of water changes in response to elevation changes.

The residence time of coal particles 41 in the coal bed 39 is a function of the composition and structure and the mean particle size and size distribution of the feed coal particles 51 inputted into the drier. The height of the coal bed 39 is, in turn, a function of the desired residence time. Concerning the importance of coal particle structure, the moisture content of younger, lower grade coals, such as lignites and sub-bituminous coals, is contained largely within pores in the coal particle. In contrast, the moisture content of older, higher grade coals, such as bituminous and anthracite coals, is contained largely on the surface of the particles. Accordingly, it is important that any thermal drying process for sub-bituminous and lignite coals heat the coal particles to a sufficient temperature not only to vaporize surface moisture but also to vaporize the moisture contained in the pores.

Based on the foregoing, the residence time should be sufficient for the coal particles 41 to establish thermal equilibrium with the steam surrounding the coal particles. Thermal equilibrium for a coal particle 41 is established when substantially all of the pores in the coal particle 41 are filled with steam having a moisture content (or steam density) substantially equivalent to the moisture content desired for briquetting. While not wishing to be bound by any theory, it is believed that at equilibrium the composition and temperature of the steam in the pores of the particles is substantially the same as the composition and temperature of the steam surrounding the particles. This belief reflects the high porosity and permeability of most lignite, sub-bituminous and bituminous coals. Typically, the residence time required to establish thermal equilibrium remains substantially constant for different degrees of superheat of the coal bed 39. In one embodiment, the residence time is longer than the time required to established thermal equilibrium as the fluidized bed conditioner acts as a surge bin for the briquetter 23 located directly below the fluidized bed conditioner 11. The use of steam to fluidize the coal bed 39 avoids overdrying of the coal particles and maintains a constant steam envelope around the coal particles. Fire hazards commonly associated with longer residence times are avoided by the absence of oxygen surrounding the coal particles in the coal bed 39.

The coal bed 39 may have any configuration that permits the steam to substantially uniformly fluidize the particles in the coal bed 39. For example, the coal bed 39 may be round, square, or rectangular depending upon the demands of the industrial plant. The area of the coal bed 39 is a function of the capacity of the fluidized bed conditioner 11 and the fluidizing velocity through the coal bed 39.

The height and cross-sectional area of the disengagement zone 37 are a function of the fluidizing velocity, the mean particle size and size distribution of the coal particles in the coal bed 39, and the desired mean particle size and size distribution of the dried coal to be inputted into the briquetting assembly 23. The height and/or cross-section area of the disengagement zone 37 should be increased if a smaller fraction of coal fines is desired to be treated by the particle collector 13 and decreased if a larger fraction of coal fines is desired to be treated by the particle collector 13. The fluidized bed conditioner 11 is supported by I-beams 50 by means of flanges 52.

Referring to FIGS. 1, 3, 4, 5, and 6, the operation of an embodiment of the fluidized bed conditioner assembly will now be described. Feed coal particles 51 from coal feeder 9 is inputted into the fluidized bed conditioner 11 typically by means of screw conveyor. The feed rate of the feed coal particles 51 is a function of the rate of output of dried coal particles 53 from the fluidized bed conditioner 11. As described above, the coal particles 41 in the coal bed 39 are heated by the combined effects of the heat exchange tubes 33 and the steam.

Coal particles 41 in contact with the heat exchange tubes 33 and the steam transfer heat from the heat exchange tubes 33 to the coal bed 39. The transfer of heat is facilitated by the agitation of coal particles 41 in the coal bed 39 as a result of the action of bubbles in the coal bed 39. The bubbles are caused by the passage of the steam through the bed. As coal particles 41 in the coal bed 39 are heated by the steam, the temperature of the coal particles 41 is increased, thereby vaporizing moisture in the pores of coal particles 41, reducing the moisture content of the coal particles 41, and filling the pores in the coal particles 41 with steam.

The temperature of the coal bed 39 and steam are controlled by increasing or decreasing the heat input into the heat exchange tubes 33 by the heater 19. This is accomplished by increasing or decreasing the heat input to the thermal medium in direct response to coal bed temperature data supplied by a thermocouple contacting the lower region of the coal bed 39. As noted above, the final temperature and moisture content of the coal particles 53 outputted by the fluidized bed conditioner 11 is a function of the temperature of the coal bed 39 and therefore controlled by adjusting the heat input into the heat exchange tubes 33 by the heater 19. As will be known and understood by those skilled in the art, the heater 19 may be any device, such as a coal fired heater or boiler, capable of heating the thermal medium that is passed through the heat exchange tubes 33.

The dried coal particles 41 shrink in size due to the removal of moisture from the pores of the coal particles 41. When they reach the bottom of the coal bed 39, the coal particles 41 pass between the tubes 33 and fall into the output hopper 42.

As the steam exits the coal bed 39, fine and very fine coal particles 55, 57 become entrained in the steam and enter the disengagement zone 37. As the fine and very fine coal particles 55, 57 move upward, they are heated by the steam. As the cross-sectional area of the disengagement zone 37 increases and the velocity of the fine coal particles decreases 55, the fine coal particles 55 dissociate from the steam and travel back to the coal bed 39. The very fine coal particles 57 are carried with the steam to particle collector 13. As will be known and understood by those skilled in the art, particle collector 13 may be any device capable of separating entrained particles from gas, such as a cyclone or electrostatic precipitator.

The majority of the very fine particles 57 are separated from the steam by the particle separator 13. The separated particles 59 are conveyed beneath the coal bed 39 where they are blended with dried coal particles 53 outputted by the coal bed 39 in the output hopper 42. The particle separator 13 is preferably located within the conditioner housing 31 to reduce heat losses and cooling of the very fine coal particles 59. As will be known by those skilled in the art, the particle separator 13 may also be located externally to meet local design conditions.

Steam passes from the particle separator 13, through a first recycle conduit 61, and to the fluidizing blower 15. The fluidizing blower 15 is any device capable of circulating the steam through the coal bed 39 at the selected fluidizing velocity. A positive displacement blower such as the blower sold under the tradename "ROOTS" is preferred for ease and accuracy of controlling the fluidizing velocity. The size of the fluidizing blower 15 is a function of the area of the coal bed 39 and the fluidizing velocity.

Steam from the fluidizing blower 15 is heated by the compression process, further superheating the steam and forcing the steam through the input duct 63 into the fluidizing distributor 35. The heat supplied to the steam by the fluidizing blower 15 will remain substantially constant during operation since the fluidizing velocity remains substantially constant during operation. The steam enters the tubes 49 by way of the input duct 63. Because the tubes contain plugs 65 at the opposite end, the steam is forced out of the tube 49 into the coal bed 39. The fluidizing distributor 35 circulates the steam substantially uniformly across the cross sectional area of the coal bed 39. The steam circulates through the coal bed 39 and across the heat exchange tubes 33, repeating the above process.

Excess steam generated during the drying process passes through condenser outlet 40 to the steam condenser 17 where it is removed from the system. The steam condenser 17 may be any apparatus that removes steam from the drying process by condensation. The vent from the steam condenser 17 is sealed by a water weir which controls the pressure of the steam and the pressure in the fluidized bed conditioner 11. The fluidized bed conditioner 11 may operate at both subatmospheric, atmospheric, and superatmospheric pressures. Atmospheric pressure is preferred to reduce construction and operating costs.

Referring to FIGS. 2 and 3, the coal particles 53 outputted by the fluidized bed conditioner pass through the output hopper 42 to the pressure feeder 25. The pressure feeder 25 may be any device which exerts pressure on the coal particles to be inputted into the briquetter 23, thereby maintaining a desired degree of compaction in the coal particles. Preferably, the pressure feeder 25 is a screw feeder with accurate controls to exert constant pressure on the coal particles to be briquetted. The pressure exerted by the pressure feeder 25 is related to the density of the briquette and the compaction pressure exerted by the briquetter 23. In a double roll-type briquetter, for example, pressure feeder 25 exerts pressure on the coal particles inputted into the briquetter 23, forcing the rolls of the briquetter 23 to separate. The separation of the rolls increases the pressure exerted on the coal particles thereby increasing the specific density of the coal particles in the briquette. A minimum briquette density is required to ensure that the outputted briquettes are properly compacted and will not absorb moisture or spontaneously ignite in coal piles. Preferably, the pressure exerted by the pressure feeder 25 is directly related to the gap between the rolls of the briquetter 23.

The pressure feeder 25 is sealed from the atmosphere to minimize moisture loss and highly insulated to reduce heat loss. Sufficient insulation is required to eliminate moisture condensation around the dried coal particles. Compression of the coal particles by the pressure feeder 25 forms a seal between the fluidized bed conditioner 11 and the briquetter 23. By sealing the coal particles to be inputted into the briquetter 23, a controlled atmosphere is maintained around the coal particles, beginning in the fluidized bed conditioner 11 and extending to the briquetter 23. This controlled atmosphere has substantially the same temperature, pressure and composition as the atmosphere in the fluidized bed conditioner 11. The controlled atmosphere maintains the moisture content and temperature of the coal particles substantially constant. To further reduce heat loss in the system the conditioner housing 31, first recycle conduit 61, pressure feeder 25, fluidizing blower 15, and other exposed surfaces are highly insulated. The insulation maintains isothermal conditions throughout the system to maintain selected conditions for briquetting.

The dried coal particles pass from the pressure feeder 25 into the briquetter 23. The briquetter 23 may be any of the numerous system configurations which briquettes coal particles under pressure while maintaining a confined volume. The compaction pressure exerted by the briquetter 23 is directly related to the density and strength of the briquette. The preferred briquetter is a double roll briquetting machine. For roll briquetters, the specific roll pressure is a function of the roll diameter of the briquetter, the pressure exerted by the pressure feeder 25, the size of the briquettes, the temperature of the coal particles to be compressed, and the desired final density of the briquette.

During briquetting, the pores and inter-particle void spaces are reduced in size and steam contained in the pores and in the inter-particle void spaces is compressed above the saturation pressure thereby converting the steam into water and further increasing the temperature of the coal particles. The collapse of the pores and the inter-particle void spaces increases the density and strength of the briquette. In one aspect of the present invention, the presence of steam in the pores and inter-particle spaces during briquetting produces a high density and high strength briquette without the addition of a binder.

As discussed above, the use of steam to fluidize the coal bed 39 creates a controlled atmosphere that is substantially free of compressible gases. The absence of compressible gases in the particle pores and inter-particle void spaces is very conducive to producing a good briquette at a relatively high output with little swelling or cracking of the briquettes. For example, a roll briquetter in conventional briquetting operations (which briquette coal particles with compressible gases in the pore structure) requires a low roll peripheral speed of about 12 meters per minute to expel compressible gases during briquetting. In the subject invention, the peripheral speed may be significantly increased because compressible gases are not expelled from the coal particles during briquetting. As stated above, the steam in the pores of the coal particles and inter-particle void spaces does not resist compression but condenses as the coal particles are compressed. The increased peripheral speed translates into decreased capital requirements and improved briquette quality.

The briquettes are conveyed to the feed coal preheater 27 where they are mixed with raw feed coal. Prior to blending, the raw feed coal may be crushed to a desired size by devices known in the art. The blending of the raw feed coal and the briquettes heats the raw feed coal and cools the briquettes.

The raw feed coal and briquettes are conveyed to the briquette cooler 29 which may include many differing designs for conveying and cooling in a single unit. Raw feed coal falls though an appropriately sized screen which will not pass briquettes. The briquettes remain on the screen and are conveyed to the outlet of the briquette cooler 29 where the cooled briquettes are removed as product.

To start up the fluidized bed conditioner and initiate the foregoing drying and briquetting process, a fluidizing gas is circulated through the fluidizing blower 15. The initial fluidizing gas typically is composed primarily of air and a small amount of moisture. The heat exchange tubes 33 supply heat to the fluidizing gas and coal bed 39. As the coal bed 39 increases in temperature, moisture in the coal particles vaporizes, increasing the fraction of the fluidizing gas that is steam. Steam from the coal particles quickly displaces air in the fluidizing gas, changing the environment surrounding each coal particle. When the fluidizing gas is in an equilibrium state, the fluidizing gas is substantially steam and is substantially free of air and other compressible gases. The volume fraction of compressible gases may increase if the system has leaks or the coal particles evolve small quantities of carbon dioxide during heating. Small quantities of compressible gases will not affect briquette quality if roll speeds in the roll briquetter are appropriately controlled to expel the compressible gases.

EXAMPLE

The foregoing process was applied to a sub-bituminous coal from the Belle Ayr and Eagle Butte mines in the Powder River Basin in Wyoming. The coals in the Powder River Basin contain about 0.25% by weight sulfur and about 25 to about 32% by weight water depending upon the location in the basin. Sub-bituminous coals typically contain about 20 to about 35% by weight water depending upon the coal seam location and properties. For the Belle Ayr and Eagle Butte coal, the total moisture is about 30%, depending upon seam location, time of year and other environmental factors. As stated earlier, the operating variables identified below for Powder River Basin coals do not necessarily apply to other coals. Other coals may have different compositions and structures which may affect, among other things, the relationship between the moisture in the briquettes, the briquette feed pressure, roll Speed and roll separation force (for roll briquettes), the temperature of the fluidized bed and the moisture content of the coal particles in the fluidized bed.

The raw feed coal is crushed by a coal crusher to a mean particle size between about 8 and 4 mesh (U.S.). In a coal preheater, briquettes are blended with the raw feed coal. The briquettes transfer heat to the raw feed coal which are heated to approximately 130° F. and about 20% moisture. The raw feed coal (but not the briquettes) falls through a ⅜ inch screen in the coal preheater and is conveyed to the raw coal feeder for storage.

From the raw coal feeder, the raw feed coal is conveyed by a raw coal transporter to a fluidized bed conditioner. Steam having temperatures between about 215 and 250 degrees Fahrenheit is circulated through the bed at a velocity of about 2 ft/sec. The fluidizing velocity is for a coal particle size in the coal bed of about minus 8 mesh (U.S.) with a mean coal particle size of about 800 microns. For smaller coal particles with a top size of about 30 mesh and mean particle size of about 250 microns, the fluidizing velocity should be decreased to about 1.25 ft/sec to avoid excessive particle entrainment or decreased heat transfer rate.

The fluidizing gas contains about 99% by volume steam and about 1% by volume air. The air enters into the fluidized bed conditioner with the raw feed coal. Excess steam and compressible gases are removed by a vent to the external atmosphere. The fluidized bed conditioner is operated at near atmospheric pressure (about +1 inch of water pressure above atmospheric pressure) simplifying operation and construction of the unit.

Heat is supplied to the fluidized bed conditioner by means of heat exchange tubes producing a heat transfer rate between the heat exchange tubes and the coal bed of between about 40 and about 55 Btu/hr/sqft/°F. A thermal medium, such as steam, is circulated through the heat exchange tubes and has a temperature ranging from about 50° to about 150° F. above the temperature of the coal bed, depending upon the amount of heat input required by the coal bed. Since the internal film coefficient and thermal resistance in the wall of the heat exchange tubes are relatively low, heat transfer from the thermal medium in the heat exchange tubes to the coal bed is dependant on the external coefficient between the heat exchange tubes, coal particles and fluidizing gas. The high heat transfer rate in the example is due to the selection of an optimum fluidizing velocity and use of superheated steam as fluidizing gas.

Heat input is controlled by a coal (or other fuel) fired furnace through which the thermal medium in the heat exchange tubes is circulated. Based upon experimental data, the following table presents the relationship between the temperature of the coal bed or the degree of superheat (Delta) and moisture content of the dried coal particles:

| DRYER PRODUCT MOISTURE | | | | |
|---|---|---|---|---|
| TEMPERATURE | | PRODUCT MOISTURE | | |
| BED | DELTA | HIGH | AVERAGE | LOW |
| 210 | 10.6 | 27.8 | 26.0 | 24.2 |
| 215 | 15.6 | 23.0 | 21.0 | 19.0 |
| 220 | 20.6 | 19.0 | 16.8 | 14.6 |
| 225 | 25.6 | 15.6 | 13.8 | 12.0 |
| 230 | 30.6 | 13.4 | 11.7 | 10.0 |
| 235 | 35.6 | 11.6 | 10.0 | 8.4 |
| 240 | 40.6 | 10.2 | 8.8 | 7.4 |
| 245 | 45.6 | 8.7 | 7.5 | 6.3 |
| 250 | 50.6 | 7.7 | 6.7 | 5.7 |
| 255 | 55.6 | 6.6 | 6.0 | 5.4 |
| 260 | 60.6 | 5.6 | 5.4 | 5.2 |

The data applies to a fluidized bed conditioner at 5300 ft elevation and for a boiling point of water of about 199° F. As can be seen from the average, mean and high product moisture, the product moisture is substantially consistent among dried coal particles at a given coal bed temperature. As noted above, the relationship between temperature and product moisture content may vary for coals having different compositions and structures and for varying compositions of the fluidizing gas. For example, air in the steam fluidizing the coal bed may cause the relationship to change.

To dry one ton of Powder River Basin coal from about 30 to about 10% moisture at an elevation of 5300 ft. requires about 996 Btu/lb of water evaporated or about 199 Btu/lb coal. For this drying system, the heat transfer rate from the steam in the heat exchange tubes will be about 398,000 Btu/hr, requiring about 44 sq. ft. of heat exchange tubing using the preferred technology. In a fixed or cascading bed, the heat transfer rate is about 10 Btu/hr/sqft/°F. requiring about 200 sq. ft. of heat exchange surface. The increased cost of the tubing increases both the cost of the drier and system complexity.

The minimum residence time in the fluidized bed to achieve thermal equilibrium between the coal particles and the ambient steam is about 10 seconds for a particle size of minus 8 mesh. To ensure consistency of the temperature and moisture content of dried coal particles, a residence time of about 10 minutes was selected. However, shorter residence times may be used with equal success.

After drying, the coal particles are transferred under the pressure of a screw feeder to a roll-type briquetter. For Powder River Basin coals, preferred briquetting conditions measured in a test program at about 5,300 feet above sea level are a coal particle temperature of about 215° to about 260° F., most preferably about 240° F. and a moisture content of about 5 to about 10% moisture, most preferably about 8% moisture. The preferred coal particle size and size distribution is about minus 8 mesh with a straight line size distribution as described on a Rosin Ramlers plot of particle size as a function of cumulative sample weight. The preferred briquetting pressure is about 60 to about 90 kN/cm at a roll diameter of 1 meter. These conditions will produce a briquette in a roll-type briquetter having a density of at least 1.25 gm/cc (78 lb/cu ft), which is very close to the in situ seam coal density of about 80 lb/cu ft.

After briquetting, the briquettes have a temperature of about 250° F. In the coal preheater, the briquettes are rapidly cooled from about 250° F. to about 150° F.

It should be understood that the foregoing discussion is directed to a specific embodiment for Powder River Basin coal. In that regard, it is anticipated that certain variables will change if the process is applied to other types of coals.

The foregoing description of the invention has been presented for purposes of illustration and description. Further, the description is not intended to limit the invention to the form disclosed herein. Consequently, variations and modifications commensurate with the above teachings, and the skill or knowledge in the relevant art are within the scope of the present invention. The preferred embodiment described hereinabove is further intended to explain the best mode known of practicing the invention and to enable others skilled in the art to utilize the invention in various embodiments and with the various modifications required by their particular applications or uses of the invention. It is intended that the appended claims be construed to include alternative embodiments to the extent permitted by the prior art.

What is claimed is:

1. A method for conditioning and briquetting coal particles comprising;

(a) identifying a moisture content of dried coal particles to be outputted by a conditioner, said moisture content being dependent upon the composition and structure of said dried coal particles to be outputted by said conditioner, wherein said conditioner comprises a fluidized bed conditioner having a fluidized bed of coal particles and the moisture content of said outputted dried coal particles is a function of the temperature of said fluidized bed of coal particles;

(b) selecting a temperature of coal particles in said conditioner based on said moisture content of said dried coal particles to be outputted by said conditioner;

(c) inputting coal particles having pores into said conditioner to be dried;

(d) contacting said inputted coal particles with steam, said steam supplying heat to said inputted coal particles;

(e) maintaining said inputted coal particle temperature at about said selected temperature;

(f) outputting dried coal particles having steam in their pores from said conditioner;

(g) conveying said dried coal particles having steam in their pores from said conditioner to a briquetter; and (h) briquetting said dried coal particles having steam in their pores.

2. The method as claimed in claim 1, further comprising;

(i) sealing said outputted dried coal particles having steam in their pores from the atmosphere during said conveying step.

3. The method as claimed in claim 1, wherein the moisture content of outputted dried coal particles having steam in their pores ranges from about 5 to about 10 percent by weight water.

4. The method as claimed in claim 1, wherein said maintaining step includes controlling the temperature of a heater connected to said fluidized bed conditioner in response to said temperature of said fluidized bed of coal particles.

5. The method as claimed in claim 1, wherein said contacting step includes contacting said fluidized bed of coal particles with said steam at a predetermined velocity, said predetermined velocity depending upon mean particle size and size distribution of said inputted coal particles.

6. The method as claimed in claim 1, further comprising;

(i) keeping each of said inputted coal particles in said conditioner for a predetermined time for said inputted coal particle to achieve equilibrium with steam contacting said inputted coal particle, wherein equilibrium corresponds to said moisture content identified in step (a).

7. The method as claimed in claim 1, further comprising;

(i) keeping each of said inputted coal particles in said conditioner for a predetermined time for said inputted coal particle to achieve equilibrium with steam contacting said inputted coal particle, wherein equilibrium corresponds to the temperature of the steam contacting said inputted coat particle.

8. The method as claimed in claim 7, wherein said steam temperature is substantially the same as said temperature selected in step (b).

9. The method as claimed in claim 6, wherein said predetermined time depends upon said inputted coal particles' composition and structure and said inputted coal particles' mean particle size and size distribution.

10. A method for conditioning and briquetting coal particles comprising;

(a) identifying a moisture content of dried coal particles to be outputted by a conditioner, said moisture content being dependent upon the composition and structure of said dried coal particles to be outputted by said conditioner;

(b) selecting a temperature of coal particles in said conditioner based on said moisture content of said dried coal particles to be outputted by said conditioner;

(c) inputting coal particles having pores into said conditioner to be dried;

(d) contacting said inputted coal particles with steam, said steam supplying heat to said inputted coal particles;

(e) maintaining said inputted coal particle temperature at about said selected temperature;

(f) outputting dried coal particles having steam in their pores from said conditioner;

(g) conveying said dried coal particles having steam in their pores from said conditioner to a briguetter;

(h) briquetting said dried coal particles having steam in their pores; and (i) sealing said outputted dried coal particles having steam in their pores from the atmosphere during step, wherein said conveying step includes surrounding said outputted dried coal particles having steam in pores with a gas, said gas comprising steam from said conditioner.

11. The method as claimed in claim 10, wherein said gas contains at least 75% by volume steam.

12. The method as claimed in claim 10, wherein said gas contains condensible gases.

13. The method as claimed in claim 12, wherein said condensible gases comprise alcohol.

14. A method for conditioning and briquetting coal particles comprising;

(a) identifying a moisture content of dried coal particles to be outputted by a conditioner, said moisture content being dependent upon the composition and structure of said dried coal particles to be outputted by said conditioner;

(b) selecting a temperature of coal particles in said conditioner based on said moisture content of said dried coal particles to be outputted by said conditioner;

(c) inputting coal particles having pores into said conditioner to be dried;

(d) contacting said inputted coal particles with steam, said steam supplying heat to said inputted coal particles;

(e) maintaining said inputted coal particle temperature at about said selected temperature;

(f) outputting dried coal particles having steam in their pores from said conditioner;

(g) conveying said dried coal particles having steam in their pores from said conditioner to a briguetter;

(h) briquetting said dried coal particles having steam in their pores; and (i) sealing said outputted dried coal particles having steam in their pores from the atmosphere during said conveying step, wherein said conveying step includes surrounding said outputted dried coal particles having steam in their pores with a gas, said gas being substantially free of compressible gases.

15. The method as claimed in claim 14, wherein said gas comprises steam.

16. The method as claimed in claim 15, wherein substantially all of the void spaces between said outputted dried coal particles having steam in their pores contain said steam.

17. The method as claimed in claim 14, wherein said gas contains less than about 25% by volume compressible gases.

18. The method as claimed in claim 1, wherein substantially all of said pores in said outputted dried coal particles having steam in their pores in step (g) contain steam.

19. The method as claimed in claim 1, wherein at least 75% of the void fraction in said outputted dried coal particles having steam in their pores in step (g) contain steam.

20. The method as claimed in claim 1, wherein a plurality of void spaces exist between said outputted dried coal particles having steam in their pores and said briquetting in step (h) condenses substantially all of said steam in said pores and said void spaces.

21. The method as claimed in claim 1, wherein substantially all of said steam in step (d) comprises steam produced from heating said inputted coal particles in said conditioner.

22. The method as claimed in claim 1, wherein said coal particles comprise sub-bituminous coal particles.

23. The method as claimed in claim 1, wherein said dried coal particles having steam in their pores in said briquetting step contain substantially no binder.

24. An apparatus for producing briquettes of coal comprising:

means for drying coal particles having pores to a selected moisture content including:

a first inlet and a first outlet for coal particles, said first inlet communicating with said first outlet;

a bed of coal particles located between said first inlet and first outlet;

means for contacting a fluidizing gas with said bed of coal particles to convert moisture in said particles' pores into steam, wherein said fluidizing gas substantially comprises steam; and means for supplying heat to said fluidizing gas to maintain a selected temperature for said bed of coal particles, wherein said selected bed temperature depends upon said selected moisture content for coal particles to be outputted by said means for drying coal particles;

means for briquetting coal particles outputted by said means for drying; and means for feeding said outputted coal particles from said means for drying coal particles to said means for briquetting.

25. The apparatus claimed in claim 24, wherein said means for feeding is sealed from the atmosphere to maintain said outputted coal particle temperature and moisture content substantially constant.

26. The apparatus claimed in claim 24, wherein said outputted coal particles in said means for feeding are surrounded by a gas, said gas comprising fluidizing gas from said means for drying coal particles.

27. The apparatus claimed in claim 24, wherein substantially all void spaces between said outputted coal particles contain steam.

28. The apparatus claimed in claim 26, wherein said gas contains at least 75% by volume of steam.

29. The apparatus claimed in claim 24, wherein said steam contacting said bed contains less than about 25% by volume compressible gases.

30. The apparatus claimed in claim 24, wherein said means for supplying heat includes a heating means operatively connected to a heat exchange means, said heat exchange means contacting said bed substantially uniformly across a cross-section of said bed and said heating means supplies heat to said heat exchange means in response to said bed temperature.

31. The apparatus claimed in claim 24, wherein said means for contacting includes a plurality of tubes substantially uniformly distributed across a cross-section of said bed.

32. The apparatus claimed in claim 24, wherein said means for briquetting is a roll briquetter having a gap between two rolls and said means for feeding applies pressure to said outputted coal particles being inputted into said roll briquetter, said pressure being a function of said gap.

33. The apparatus claimed in claim 30, wherein said coal particles comprise sub-bituminous coal having a moisture content of about 20 to about 35% by weight water and said heat exchange means has a heat transfer rate ranging from about 40 to about 55 Btu/hr/sqft/°F.

34. The apparatus claimed in claim 24, wherein said particles to be inputted into said means for drying comprise sub-bituminous coal having a moisture content of about 20 to about 32% by weight water.

35. The apparatus claimed in claim 34, wherein said selected moisture content for said outputted coal particles ranges from about 5 to about 10 percent by weight water.

36. The apparatus claimed in claim 34, wherein said selected temperature for said bed ranges from about 215° to about 260° F.

37. The apparatus claimed in claim 34, wherein said bed temperature has a degree of superheat ranging from about 10° to about 60° F.

38. The apparatus claimed in claim 30, wherein said heat exchange means contains a heat transfer medium having a temperature of about 50° F. to about 150° F. above said bed temperature.

39. The apparatus claimed in claim 24, wherein said steam in said means for drying is at about atmospheric pressure.

40. The apparatus claimed in claim 24, wherein said fluidizing gas in said means for drying coal particles contains less than about 25% by volume compressible gases.

41. The apparatus claimed in claim 24, wherein said fluidizing gas in said means for drying coal particles contains at least 75% by volume steam.

* * * * *